United States Patent [19]

Linski

[11] Patent Number: 4,848,834

[45] Date of Patent: Jul. 18, 1989

[54] INFANT FOOD CATCH

[76] Inventor: Ron Linski, 1230 Elm St., El Cerrito, Calif. 94530

[21] Appl. No.: 301,195

[22] Filed: Jan. 24, 1989

[51] Int. Cl.[4] ..... A47D 15/00

[52] U.S. Cl. ..... 297/182; 108/50

[58] Field of Search ..... 297/182, 136; 108/50, 108/24

[56] References Cited

U.S. PATENT DOCUMENTS

| | | | |
|---|---|---|---|
| 1,050,205 | 1/1913 | Conley | 297/182 |
| 1,309,343 | 7/1919 | Thomas | 297/182 |
| 1,377,860 | 5/1921 | Thomas | 297/182 |
| 2,585,434 | 2/1952 | Caponera | 297/182 |
| 2,700,413 | 1/1955 | Williams | 297/182 |
| 2,938,574 | 5/1960 | Brown | 297/182 |
| 3,298,736 | 1/1967 | Decker | 297/182 |
| 4,094,547 | 6/1978 | Zampino et al. | 297/182 |
| 4,165,123 | 8/1979 | Hutson | 297/153 |
| 4,170,181 | 10/1979 | Glasgow | 108/50 |
| 4,659,143 | 4/1987 | MacLennan | 297/182 |

*Primary Examiner*—James T. McCall

*Attorney, Agent, or Firm*—Townsend and Townsend

[57] ABSTRACT

A food pouch (16) for use with an infant's chair (6) of the type that attaches to the top of a table (4) catches food and debris dropped or thrown by the seated infant which would otherwise land on the floor. The pouch (16) is a generally liquid impervious surface that is attached at one pouch end (20) to the back portion (12) of the child's chair, and is attached at the other pouch end (18) to the underside of the table to which the chair is attached. In a preferred embodiment, the invention includes a spreader (40) to spread the portion of the pouch attached to the back of the chair, thereby maximizing the pouch area available for catching food and debris. The other end of the pouch is attached to the underside of the table, such as by using single (96) or double-sided (80) adhesive tape, Velcro brand hook and loop strips (104, 106), or hooks (98). The food pouch may be disposed of after each use or may be reused. An apparatus, a method and a kit are disclosed.

32 Claims, 3 Drawing Sheets

INFANT FOOD CATCH

BACKGROUND OF THE INVENTION

The invention relates generally to devices for catching food and other debris which a child in a seat attached to a table may drop or throw, and more particularly to a device for use with a child's seat of the type that attaches to a table top.

Infants and young children appear to be born with an instinct for throwing or spilling or dropping food. utensils, dishes and anything else within reach while being fed. After feeding the child, the parent is faced with the problem of not only cleaning up the child but cleaning up the floor area surrounding the child as well. One approach to minimizing the after-feeding clean-up has been to spread an apron-like device around a child's high chair, such as disclosed by Caponera in U.S. Pat. No. 2,585,434, or by Brown in U.S. Pat. No. 2,938,574. Other proposed solutions have been to surround a child seated in a high chair with a canopy located at roughly the level of the chest, as disclosed by the patents to Thomas, U.S. Pat. Nos. 1,309,343 and 1,377,860.

Such prior art solutions have been adapted to the more modern use of a portable clip-on baby seat as disclosed in the patent to MacLennan, U.S. Pat. No. 4,659,143. MacLennan attaches a food catcher to a table top on both sides of a child's seat, the food catcher generally surrounding and extending beneath the seated child. MacLennan's device is somewhat cumbersome, however, and suffers from the drawback that the food catch is not immediately replaceable. What is needed is a portable and compact food catch for use with a child's clip-on seat, that permits quick and easy replacement of the catch.

SUMMARY OF THE INVENTION

The present invention is an apparatus for catching food, utensils and the like dropped or thrown by a child seated in a portable seat of the type that attaches to a table top. Such portable seats are known in the art, as exemplified by U.S. Pat. No. 3,059,965 (Fornetti, 1962).

The present invention includes a disposable food pouch, attached at a front end to the underside of the tabletop to which the child's seat is attached, and attached at a rear end to a rear portion of the child's seat. The pouch substantially surrounds the child from the level of the table top downward. A preferred embodiment includes a spreader for extending the rear portion of the pouch sideways to increase the area available for catching objects dropped or thrown by the seated child.

The pouch has a generally shallow pouch shape and is deep enough so the legs of the seated child do not reach the bottom of the pouch. The pouch is generally water impervious.

The front-most portion of the pouch is attached to the underside of the table, generally in front of the seated child. The attachment is made, in a first preferred embodiment, with industrial grade double or single sided adhesive tape. Tape permits the front portion of the pouch to be adhesively attached to a non-specific portion of the table. For instance it is not necessary that the parent crouch down and look beneath the table to see where the pouch should be attached. In other embodiments, more suitable for use on a table with which the pouch is used repeatedly, such as the family dining room table. Velcro brand hook and loop strips can be permanently affixed to the underside of the table and to the pouch. Other attachment elements, such as snaps or magnetic catches, can also be used as well.

After the child has eaten, and presumably filled a portion of the pouch with food and other debris, the child is removed from the seat. The rear portion of the pouch may be lowered towards, for instance, a bucket into which the contents of the pouch are emptied. After such cleaning, the pouch is reattached to the back of the seat and is ready for reuse. Alternatively, the pouch, with food and debris therein, may be removed and discarded.

The present invention advantageously provides an apparatus for catching food or debris dropped by a seated child. The present invention is compact, inexpensive and may include a disposable or a reusable pouch.

Other aspects, features and advantages of the invention will appear from the following description wherein the preferred embodiment has been set forth in detail in conjunction with the accompanying drawings.

DETAILED DESCRIPTION OF THE PREFERRED EMBODIMENT

Figure 1:
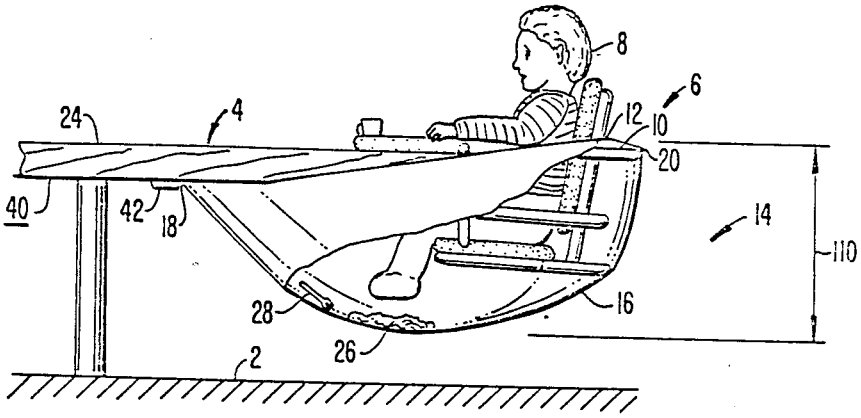
FIG. 1 is a side view of a food pouch according to the present invention.

FIG. 1 shows a floor 2 supporting a table 4 to which a portable high chair 6 has been attached, with a child 8 seated in the chair 6. Chair 6 in FIG. 1 is known in the art and includes a horizontal frame member 10 surrounding the rear portion 12 of the chair 6.

The present invention, shown generally as 14, includes a pouch 16 having a first pouch end 18, a second pouch end 20, and a perimeter 22. As shown in FIG. 1, pouch 16 substantially surrounds the seated child 8, from the level of table top 24 downward, to catch food or other debris 26 or utensils 28 dropped or thrown by the child 8.

Figure 4A:
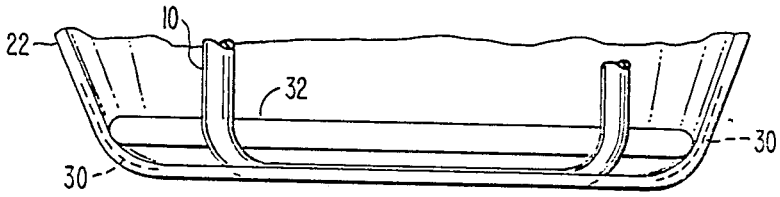
FIG. 4A is an enlarged view of a portion of FIG. 2.
Figure 4B:
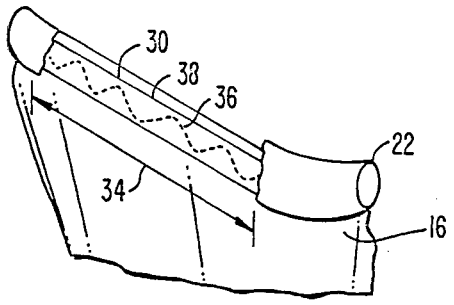
FIG. 4B is a perspective cutaway view of a portion of FIG. 4A.

The second pouch end 20 is attached to the rear portion 12 of chair 6 by stretching end 20 around and slightly over portion 12. A preferred embodiment, shown in detail in FIG. 4A, includes a length of elastic 30 attached to the perimeter 22 of the second pouch end 20 adjacent member 12. Elastic 30 allows end 20 to fit generally around and over portion 12 of chair 6 and to elastically contract, to remain in position. In embodiments including a spreader 32 (to be described below), elastic 30 is disposed in perimeter 22 to encompass the free ends of the spreader 32. As shown in FIG. 4B, a length 34 of elastic material 30 is attached to the perimeter 22 of pouch 30 with stitching 36 and/or adhesive 38. Length 34 is not critical and about 6"(15 cm) works well. Alternatively, the second pouch end 20 could be attached to the rear portion 12 of chair 6 using attachment devices similar to what is used to attach the first pouch end 18 to the underside of table 4, i.e., adhesive tape. Velcro brand material, hooks and the like.

With reference to FIG. 1, the first pouch end 18 is attached to the under surface 40 of table 4 by an attaching device, shown generally as 42, which will be described in more detail below.

Figure 2:
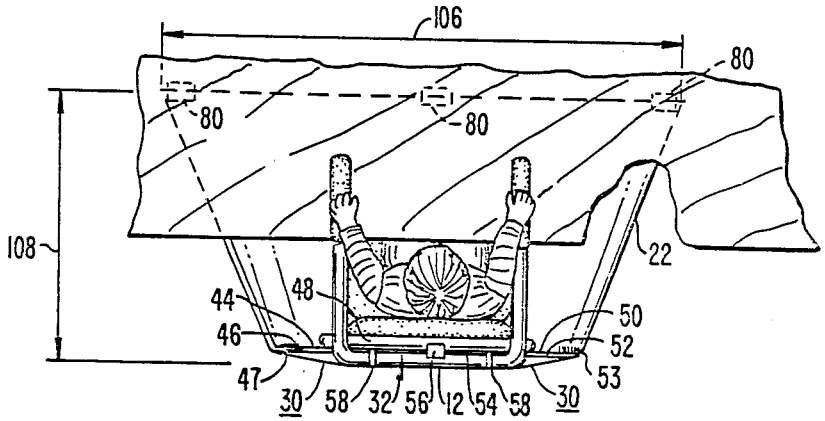
FIG. 2 is a top view of the food pouch of FIG. 1.
Figure 3:
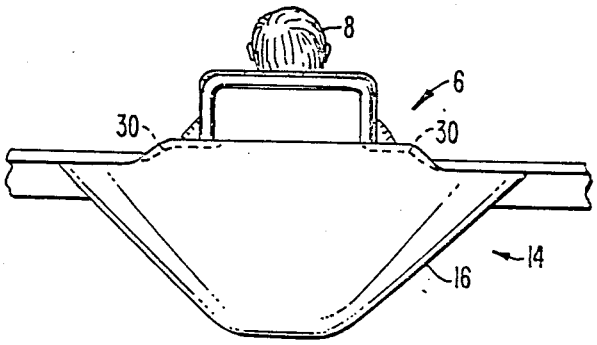
FIG. 3 is a rear view of the food pouch of FIG. 1.

As shown in FIG. 2, apparatus 14 includes a spreader 32, to spread or expand the second pouch end 20. Such spreading increases the pouch area available to receive objects 26, 28 dropped or thrown by the child 8. For ease of transportation spreader 32 may include a first spreading arm 44 having a distal end 46 and a medial end 48, and a second spreading arm 50 having a distal end 52 and a medial end 54. Medial ends 48 and 54 are joined together with a connecting member 56.

Figure 5A:
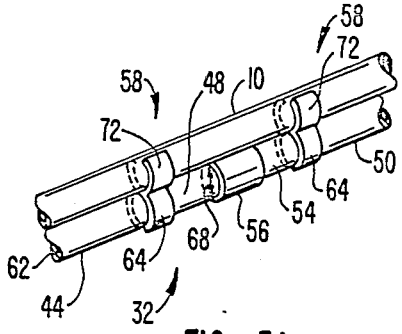
FIG. 5A is an enlarged prospective view of a portion of FIG. 2.
Figure 5B:
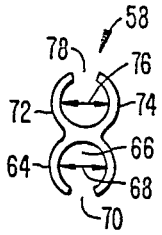
FIGS. 5B and 5C are end and side view of attaching member 58.
Figure 5C:
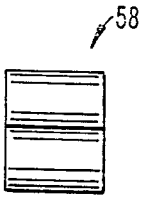
Figure 5A:
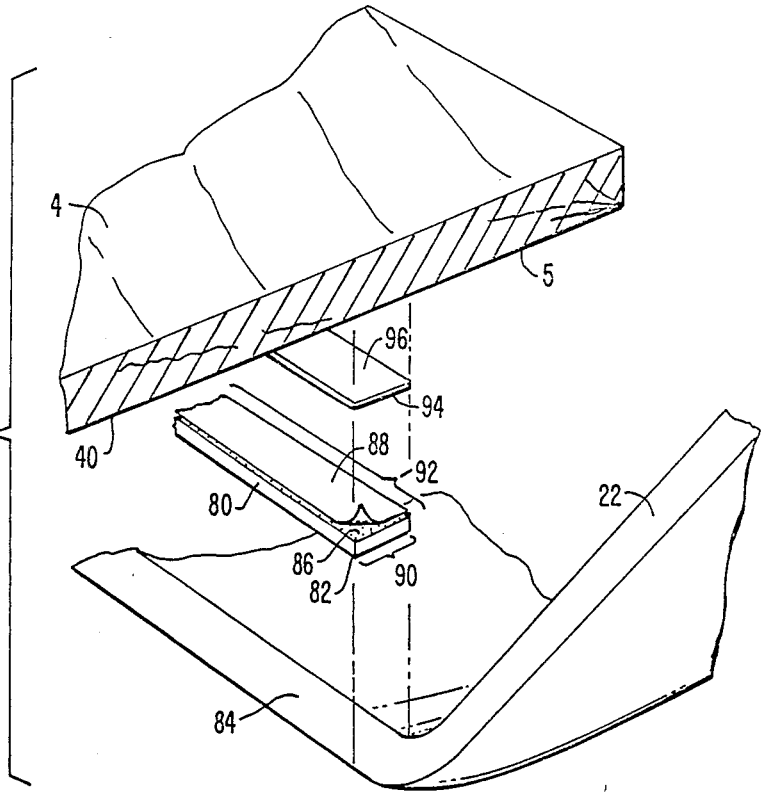

Spreader 32 is removably attached to member 10 of chair 6 with one or more attaching members 58. In the embodiment shown in FIGS. 2. 5A and 5B. first and second spreading arms 44. 50 and attaching member 58 have a similar cross section. Attaching member 58 has a first transverse dimension 60 sized to encompass arms 44 50 which have a slightly smaller transverse dimension 62. Medial ends 48, 54 of arms 44, 50 engage and are frictionally retained by member 56. Although FIGS. 5A and 5B show arms 44 and 50 and connector 56 as having a substantially cylindrical cross section, other cross sections, such as rectangular, could be used as well. Similarly, while connecting member 56 is shown as surrounding arms 44 and 50, connecting member 56 could be made to fit within arms 44 and 50 if medial ends 48 and 54 are hollow.

As shown in FIGS. 5A, 5B, attaching member 58 is an open FIG. 8 shaped clip. Member 58 includes a first curved surface 64 surrounding an opening 66 whose transverse dimension 68 is sized to frictionally accommodate arms 44 or 50. Surface 64 defines an entry gap 70 sized to allow surface 64 to slip over and frictionally retain arm 44 or 50. Member 58 further includes a second curved member 72 surrounding an opening 74 whose transverse dimension 76 is sized to frictionally retain member 10 of chair 6. Surface 72 defines an entry gap 78 sized to allow surface 72 to slip over and retain member 10. Attaching member 58 is preferably fabricated from a flexible resilient plastic that allows surface 72 to surround and frictionally engage member 10 of chair 6, and surface 64 to surround and frictionally retain arms 44 or 50. Alternatively member 58 may be made of other resilient materials such as metal. In the preferred embodiment of FIG. 4A. two members 66 are employed. If member 10 of chair 6 has other than the cylindrical cross section shown in FIGS. 5A, 5B. then of course the cross section of surfaces 64. 72 will be chosen to accommodate and frictionally retain such other cross section.

Spreading arms 44, 50 are plastic PCV type pipe, having a diameter of approximately 0.5"(1.2 cm) with a total length, from distal end 46 to distal end 52, of about 18"(46 cm) to about 36"(92 cm). and connecting member 56 is suitably sized plastic pipe. Other materials, such as metal or wood, may be used as well. Attaching member 58 may be permanently attached to spreader 32 and/or to member 10 of chair 6. Spreader 32 may be of unitary construction such as would result if the first and second arms 44, 50 were permanently joined at medial ends 48, 54. Alternatively, spreader 32 may be telescopic for convenience in transporting the present invention.

Figure 6B:
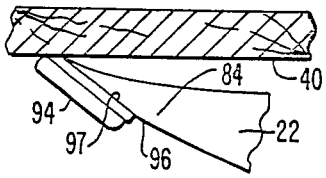
FIGS. 6A, 6B and 6C show various means for attaching the second end of the pouch to the underside of the table shown in FIG. 1.

FIG. 6A shows a first preferred attaching device 42, double-sided adhesive tape 80 which attaches the second pouch end 20 to the lower surface 40 of table 4. Double sided adhesive tape 80 has a first adhesive surface 82 that adheres to pouch end 18 at region 84, adjoining lower surface 40, and an upper adhesive portion 86, normally covered by a peel-off strip of paper or plastic 88. In use, peel off strip 88 is removed and upper adhesive portion 86 is pressed against table underside 40, thereby adhesively attaching portion 84 of pouch 16 to table 4. As shown in FIG. 2 several portions of adhesive 80, for example three, may be used. With reference to FIG. 6A, tape 80 has a width 90 of about 1"(2.5 cm) and a length 92 about 2"(5 cm). although these dimensions may be varied. In practice. Scotch brand mounting tape, catalog no. 144, item 34-7023- 2055-6 has been found to work satisfactorily. Alternatively, similarly dimensioned single-sided adhesive carpet tape such as manufactured by Manco, Inc. of Cleveland, Ohio has also been found to work. FIG. 6B shows a preferred embodiment using one or more segments of single-sided tape 94, wherein a single adhesive side 96 mounts an external portion 97 of perimeter portion 84 of pouch 16 to the undersurface 40 of table 4.

Figure 6C:
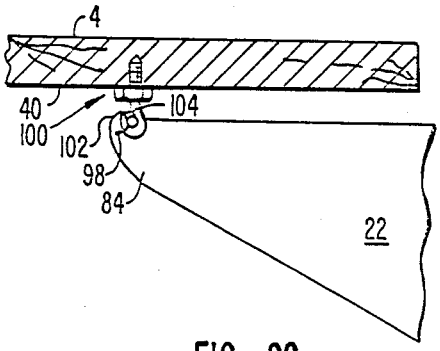

FIG. 6C shows a alternative preferred embodiment wherein attachment 42 includes generally C-shaped hooks 98, which are permanently attached to the undersurface 40 of table 4. Hooks 98 are secured to undersurface 40 by adhesive 100 or by screwing hooks 98 into the undersurface 40, depending upon the type of hook used. Hooks 98 are commonly used to hang coffee cups within kitchen cabinets and have a transverse dimension 102 of about 1"(2.5 cm). As shown in FIG. 6C. a perimeter portion 84 of pouch 16 is engaged on the hook portion 104 of hook 98 which penetrates pouch 16. Grommets (not shown) can be used along end 18 of pouch 16, especially if pouch 16 is to be reused. Three such hooks 98 are used to support the second end 20 of pouch 16 as shown in FIG. 2, although more or fewer hooks may be used.

Figure 6D:
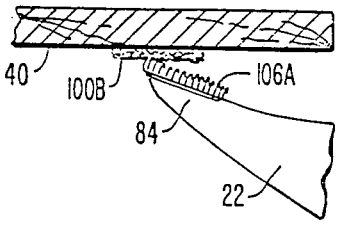

The attaching devices 42 shown in FIGS. 6A–6C are especially suitable for use with a disposable pouch 16, whereas the embodiment shown in FIG. 6D is especially well suited for use with a reusable pouch 16. In FIG. 6D, a first portion of Velcro brand hook and loop strip 106A is permanently attached to a perimeter portion 84 of pouch 16 (by adhesive, for example) while a mating portion of Velcro brand hook and loop strip 106B is permanently attached (by adhesive, for example) to the underside 40 of table 4. As shown by FIG. 2 three such portions of mating Velcro brand hood and loop strips 106A, 106B may be used. In the embodiment shown in FIG. 6D, the perimeter portion 84 of pouch 16 is attached to the table under surface 40 by matingly engaging the Velcro brand hook and loop strips 106A and 106B with one another.

In using the present invention, spreader 32 is attached to member 10 of chair 6. The second pouch end 20 is then draped over the horizontal member 10 of chair 6 and spreader 32, as shown in FIG. 1. The elastic portion 30 causes the second pouch end 20 to be retained by member 10 and spreader 32. The first pouch end 18 is then attached to the table underside 40 at, for instance, three locations as shown in FIG. 2 using attachment 42.

As shown in FIG. 1, food 26 and objects 28 dropped or thrown by a child 8 in seat 6 will be caught by pouch 16. After the child has finished the meal the child is removed from seat 6. If pouch 16 is disposable, it may be removed from lower surface 40 of table 4, and from the portion 10 of chair 6, while retaining the debris and other food particles 26 within the pouch 16. The pouch 16 may then be disposed of. Alternatively, if pouch 16 is to be reused, the food and other debris 26 may be scooped out with, for example, a spoon, a sponge or a brush.

In the embodiment shown in FIG. 2, distal end 46 of arm 44 includes a spoon 47 or spatula or similar shaped aide suitable for scraping, and distal end 52 of arm 50 includes a brush 53 or sponge or the like, suitable for removing food from the inside of pouch 16. In use, the first arm 44 is disengaged from member 10 of chair 6 by pulling away from the connecting member 56 and from the attaching member 58. The spoon 47 end 46 of arm 44 may be used to scoop the debris 26 out of pouch 16. Alternatively, if a brush is needed to complete the cleaning process, the brush 53 end 52 of arm 50 may be removed from member 10, to brush away the contents of pouch 16. Alternatively, spreader 32 may be of unitary construction such that arms 44 and 50 and any aides 47, 53 on the distal ends 46, 52 thereof are integral.

The shape of pouch 16 is not critical and the material from which pouch 16 is fabricated is similarly not critical, although it is preferably substantially impervious to water. Pouch 16 may be made from a polyurethane having a thickness of perhaps 3 mils. Alternatively, the pouch 16 may be made of a more durable material such as rubberized canvas. With reference to FIG. 2, pouch 16 has a width 106 at the first end 18 of about 3 ft. to 4 ft. (1 m–1.2 m), and a front to back dimension 108 of about 3 ft. (1 m). The effective width of the second pouch end 20 is defined by the overall length of the spreader 32, and is about 3 ft. (1 m). As shown by FIG. 1, the top to bottom pouch depth 110 should be such that the feet of the child do not come in contact with the debris or other contents of pouch 16, and depth 110 is about 2′ (60 cm). All of these dimensions may, of course, be varied.

Modifications and variations may be made to the disclosed embodiment without departing from the scope of the invention as defined by the following claims.

What is claimed is:

1. An apparatus for catching matter dropped or thrown by a child in a seat of the type that attaches to the top of a table, the apparatus comprising:

a pouch having a first end, a second end and a perimeter:

first means for attaching the first end of the pouch to an underside of the table top, generally forward of a front portion of the seat; and second means for attaching the second end of the pouch to a rear portion of the seat;

the first and second ends of the pouch being disposed such that the perimeter of the pouch is substantially level with the table top, the pouch being disposed generally beneath and surrounding the child to catch matter dropped or thrown by the child.

2. The apparatus of claim 1, wherein the pouch is substantially water impervious.

3. The apparatus of claim 1, wherein the second means includes an elastic band attached to a portion of the pouch perimeter adjacent a rear of the seat.

4. The apparatus of claim 1, wherein the first means includes a length of double sided adhesive tape, disposed between an underside of the table top and a portion of the perimeter of the pouch adjacent the first end, the tape adhesively retaining the first end of the pouch to the underside of the table top.

5. The apparatus of claim 1, wherein the first means includes a length of single-sided adhesive tape, situated between an underside of the table top and an external portion of the perimeter of the pouch adjacent the first end, the tape adhesively retaining the first end of the pouch to the underside of the table top.

6. The apparatus of claim 1, wherein the first means includes a generally C-shaped hook mounted on an underside of the table top, and wherein a portion of the perimeter of the pouch adjacent the first end is engaged by the hook, the hook retaining the fist end of the pouch to the underside of the table top.

7. The apparatus of claim 1, wherein the first means includes a first strip of Velcro brand hook and loop material mounted on an underside of the table top, and a second mating strip of Velcro brand hook and loop material mounted on a portion of the perimeter of the pouch adjacent the first end, the mating of the first and second Velcro brand hook and loop strips releasably retaining the first end of the pouch to the underside of the table top.

8. The apparatus of claim 1, further including a spreader, disposed adjacent a rear portion of the seat, for extending the second end of the pouch laterally, and including means for attaching the spreader to the rear portion of the seat.

9. The apparatus of claim 8, wherein the means for attaching includes a clamp having an open FIG. 8 cross-sectioned shape.

10. The apparatus of claim 8, wherein the spreader includes first and second arms, each arm having a distal and a medial end, and means for connecting the medial ends to one another.

11. The apparatus of claim 10, wherein the distal end of the first arm includes means for scraping the inside of the pouch.

12. The apparatus of claim 11, wherein the means for scraping includes a spoon.

13. The apparatus of claim 8, wherein the distal end of the second arm includes means for removing food from the inside of the pouch.

14. The apparatus of claim 8, wherein the distal end of the second arm includes a brush.

15. The apparatus of claim 1, wherein the pouch is made of a plastic film.

16. An apparatus for catching matter dropped or thrown by a child in a seat of the type that attaches to the top of a table, the apparatus comprising:

a spreader, removably attached to a rear portion of the seat, for extending the second end of the pouch laterally;

a substantially water impervious pouch having a first end, a second end and a perimeter;

a length of elastic, disposed in a portion of the perimeter of the second end of the pouch, for elastically attaching the second end to the spreader; and means for attaching the first end of the pouch to an underside of the table top generally forward of a front portion of the seat;

the first and second ends of the pouch being disposed by the means for attaching and by the elastic such that the perimeter of the pouch is substantially level with the table top,the pouch being disposed generally beneath and surrounding the child to catch matter dropped or thrown by the child.

17. The apparatus of claim 16, wherein the means for attaching includes a length of double sided adhesive tape, disposed between an underside of the table top and a portion of the perimeter of the pouch adjacent the first end, the tape adhesively retaining the first end of the pouch to the underside of the table top.

18. The apparatus of claim 16, wherein the means for attaching includes a length of single-sided adhesive tape, disposed between an underside of the table top and an external portion of the perimeter of the pouch adjacent the first end, the tape adhesively retaining the first end of the pouch to the underside of the table top.

19. The apparatus of claim 16, wherein the means for attaching includes a generally C-shaped hook mounted on an underside of the table top, and wherein a portion of the perimeter of the pouch adjacent the first end is engaged on the hook, the hook retaining the first end of the pouch to the underside of the table top.

20. The apparatus of claim 16, wherein the means for attaching includes a first strip of Velcro brand hook and loop material mounted on an underside of the table top, and a second mating strip of Velcro brand hook and loop material mounted on a portion of the perimeter of the pouch adjacent the first end, the mating of the first and second Velcro brand hook and loop strips releasably retaining the first end of the pouch to the underside of the table top.

21. The apparatus of claim 16, further including a clamp having an open FIG. 8 cross-sectioned shape for attaching the spreader to the rear portion of the seat.

22. The apparatus of claim 16, wherein the spreader includes first and second arms each arm having a distal and a medial end, and means for connecting the medial ends to one another.

23. The apparatus of claim 27, wherein the distal end of the first arm includes means for scraping the of the pouch.

24. The apparatus of claim 23, wherein the distal end of the first arm includes a spoon.

25. The apparatus of claim 23, wherein the distal end of the second arm includes means for removing food from the inside of the pouch.

26. The apparatus of claim 25, wherein the means for removing includes a brush.

27. The apparatus of claim 16, wherein the pouch is made of a plastic film.

28. A method for catching matter dropped by a child in a seat of the type that attaches to a table top, the method comprising:

selecting a substantially water impervious pouch having a first end, a second end and a perimeter;

attaching a first end of the pouch to an underside of the table top adjacent a front end of the seat;

attaching a rear end of the pouch to a rear end of the seat;

the first and second ends of the pouch being disposed such that the perimeter of the pouch is substantially level with the table top, the pouch being disposed generally beneath and surrounding the child.

29. The method of claim 28, further comprising the steps of securing a lateral extending member to a rear portion of the seat, and wherein the second attaching step includes placing the rear end of the pouch on the laterally extending member.

30. A kit for retaining a disposable pouch having first and second ends and a perimeter substantially surrounding and beneath a child seated in a seat of the type that attaches to a table top, the kit comprising:

first means for attaching the first end of the pouch to an underside of the table top generally adjacent a front portion of the seat; and second means for attaching the second end of the pouch to a rear portion of the seat;

the first and second ends of the pouch being disposed such that the perimeter of the pouch is substantially level with the table top, the pouch being disposed generally beneath and surrounding the child for catching matter dropped or thrown by the child.

31. The kit of claim 30, further including the disposable pouch.

32. A kit for retaining a disposable pouch substantially surrounding and beneath a child seated in a seat of the type that attaches to a table top and includes a rear seat member, the kit comprising:

a disposable, water impervious pouch having a first end adapted to be secured to an underside of the table top, and a second end including an elastic portion for securing to a portion of the rear seat member;

the pouch being sized such that a perimeter of the pouch is disposed, when the first and second pouch ends are secured, substantially level with the table top, the pouch being disposed generally beneath and surrounding the child for catching matter dropped or thrown by the child.

* * * * *